US005267926A

United States Patent [19]

Schaefer

[11] Patent Number: 5,267,926

[45] Date of Patent: Dec. 7, 1993

[54] MULTIFUNCTIONAL EXERCISE DEVICE

[76] Inventor: Joseph F. Schaefer, 105 N. Main, Fessenden, N. Dak. 58438

[21] Appl. No.: 907,876

[22] Filed: Jul. 2, 1992

[51] Int. Cl.[5] ..... A63B 21/06

[52] U.S. Cl. ..... 482/94; 482/133; 482/142

[58] Field of Search ..... 482/93, 94, 102, 103, 482/133, 135, 138, 142

[56] References Cited

U.S. PATENT DOCUMENTS

| | | | |
|---|---|---|---|
| 337,942 | 3/1886 | Farley | 482/102 |
| 1,114,458 | 10/1914 | Friedli . | |
| 1,928,089 | 9/1933 | Blickman | 482/102 |
| 2,436,987 | 3/1948 | Bailleaux . | |
| 2,456,017 | 12/1948 | Park . | |
| 3,072,400 | 1/1963 | Dykinga | 482/102 X |
| 3,130,968 | 4/1964 | De Feen | 482/135 X |
| 3,558,130 | 1/1971 | Anderson . | |
| 4,248,420 | 2/1981 | Hayes | 482/131 |
| 4,316,609 | 2/1982 | Silberman . | |
| 4,383,684 | 5/1983 | Schliep | 482/133 X |
| 4,519,604 | 5/1985 | Arzounian | 482/133 X |
| 4,519,605 | 5/1985 | Leland . | |
| 4,634,118 | 1/1987 | Jensen . | |
| 4,635,926 | 1/1987 | Minkow | 482/102 |
| 4,638,995 | 1/1987 | Wilson | 482/142 |
| 4,655,448 | 4/1987 | Harder | 482/142 |
| 4,666,151 | 5/1987 | Chillier | 482/135 |
| 4,666,154 | 5/1987 | Lipscomb et al. | 482/142 |
| 4,768,775 | 9/1988 | Marshall | 482/133 X |
| 4,838,547 | 6/1989 | Sterling . | |
| 4,848,740 | 7/1989 | Van Der Hoeven | 482/103 X |
| 4,928,957 | 5/1990 | Lanier et al. | 482/908 X |
| 5,123,886 | 6/1992 | Cook | 482/103 X |

FOREIGN PATENT DOCUMENTS

| | | | |
|---|---|---|---|
| 8601735 | 3/1986 | Int'l Pat. Institute | 482/133 |

*Primary Examiner*—Robert Bahr

*Attorney, Agent, or Firm*—Lisa B. Riedesel

[57] ABSTRACT

A multifunctional exercise device having a pair of front and rear legs connected by cross members which support a seat. The cross members allow the seat to be longitudinally movable between the front and rear legs. The multifunctional exercise device also includes several attachments, which allow an operator to perform a variety of strengthening and rehabilitating exercises for various parts of the body.

7 Claims, 5 Drawing Sheets

MULTIFUNCTIONAL EXERCISE DEVICE

BACKGROUND AND SUMMARY OF THE INVENTION

The present invention relates generally to a multifunctional exercise device which can be used by an operator in performing strengthening and rehabilitating exercises for various parts of the body. The present invention may be used to strengthen and rehabilitate various muscles within the leg, knee, arm and shoulder after surgery. More particularly, the present invention relates to a multifunctional exercise device incorporating a seat which may move between the front and rear legs of the exercise device. The present invention also includes several attachments which can be secured to the legs, thereby allowing the operator to perform a variety of additional exercises. The present invention includes a minimum number of parts which can be manufactured at a relatively low cost, and can be easily assembled.

There are a variety of exercise apparatuses used to strengthen various muscles. Such apparatuses include U.S. Pat. Nos. 4,519,605; 3,072,400; 2,456,017 and 1,114,458. However, each of these patented apparatuses suffers from one or more deficiencies. For example, each of these patented apparatuses are extremely large and bulky and do not appear to be easily disassembled. In addition, each of the patented apparatuses are limited in the number of exercises and the areas of the body an operator can exercise when using the various apparatuses. Therefore, in order to perform a wide variety of exercises and to exercise several areas of the body, an operator normally would have to utilize more than one of these patented apparatuses.

Therefore, it is an object of the present invention to provide one multifunctional exercise device which will allow an operator to perform a variety of exercises for various parts of the body.

It is another object of the present invention to provide a multifunctional exercise device for therapeutic use by individuals capable of different degrees of participation or activity, depending upon the condition of the individual.

It is another object of the present invention to provide a multifunctional exercise device for use by an individual after surgery, which allows an individual to strengthen and rehabilitate various limbs of the body.

Yet another object of the present invention is to provide a multifunctional exercise device which can be readily adapted to individuals of different sizes.

Another object of the present invention is to provide a multifunctional exercise device that is relatively compact in size.

Other objects and advantages of the present invention will be apparent to those skilled in the art from the accompanying specification, drawings and claims.

DETAILED DESCRIPTION OF THE PREFERRED EMBODIMENT

Figure 1:
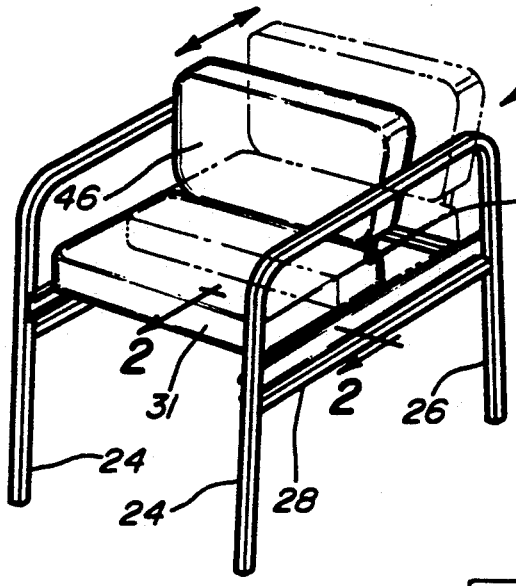
FIG. 1 is a perspective view of a first preferred embodiment of the multifunctional exercise device of the present invention.
Figure 2:
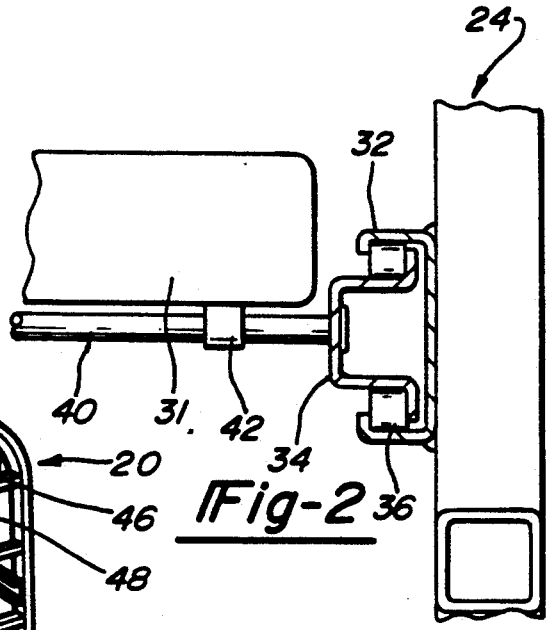
FIG. 2 is a sectional view along lines 2—2 of FIG. 1.
Figure 3:
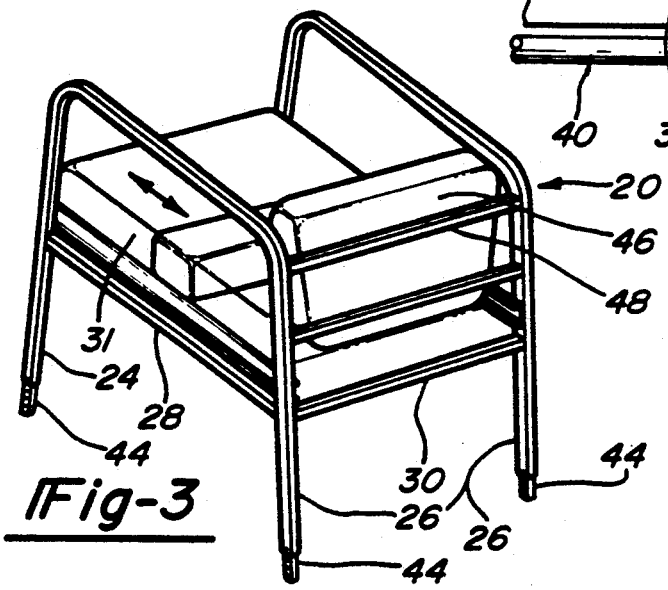
FIG. 3 is a perspective view of a second preferred embodiment of the multifunctional exercise device according to the present invention.

In the preferred embodiments shown in FIGS. 1-13, most of the structural elements of the present invention are square steel members which are secured together by threaded engagement of any sort or welding. Of course, other types of members of various cross-section may also be used in the present invention. Referring particularly to FIGS. 1-3, the present invention includes as its basic elements an exercise device 20 comprising a frame having a pair of front legs 24 and a pair of rear legs 26. The frame could also be formed of a pair of substantially U-shaped members, wherein each U-shaped member includes a front leg 24 and a rear leg 26. The front 24 and rear 26 legs are transversely secured by a side member 28. The side members 28 are attached to the front 24 and rear 26 legs by welding or threaded engagement of any sort. A rear member 30 may also be secured to each of the rear legs 26 by welding or threaded engagement of any sort. The side members 28 and rear member 30 provide support to the frame of the exercise device 20. As illustrated by FIG. 2, a pair of slidable means connect each of the front 24 and rear 26 legs and support a seat 31. The slidable means may consist of various embodiments. Specifically, as illustrated in FIG. 2, the slidable means may consist of an outer member 32 having a channel, wherein an outer member 32 is secured to the front 24 and rear 26 legs by welding or threaded engagement of any sort. An inner member 34 is retained within each of the outer members 32. Roller bearings 36, wheels, or other movable objects are located between the inner member 34 and outer member 32, thereby allowing the inner member 34 to move freely within the outer member 32. A stopping means at both ends of the outer member 32 limits the movement of the inner member 34 and therefore the movement of the seat 31. Supporting members 40 connect the inner members 34 and support the seat 31. Thus, the seat 31, supported by the supporting members 40, freely moves in a longitudinal direction between the front 24 and rear 26 legs. The seat 31 may temporarily be secured to the supporting members 40 by various means including clips 42. The slidable means may also consist of a pair of roller bearing track members secured to the front 24 and rear 26 legs, by welding or by threaded engagement of any sort. The roller bearing members are also connected by supporting members of some type. The seat 31 may be constructed of a variety of materials including a vinyl covered or fabric covered foam cushion which is secured to a plywood base.

The seat 31 should be of the approximate height that an operator sitting thereon can comfortably rest both feet parallel to the surface supporting the exercise device 20. The exercise device 20 may be adjustment to allow operators of various sizes the ability to utilize the exercise device 20. Specifically, as illustrated in FIG. 3, the length of the front 24 and rear 26 legs can be increased by attaching a lengthening means to each of the front 24 and rear 26 legs. For example, an extension leg member 44 may be secured to each one of the front legs 24 and rear 26 legs of the exercise device 20 by a variety of securing means including inserting a pin member aligned in apertures of the leg extension member 44 and the front 24 and rear 26 legs or using a threaded engagement of any sort. The extension leg member 44 may be secured to either of the preferred embodiments of the present invention as illustrated in FIGS. 1 or 3. The dimensions of the seat 31 may vary, depending upon the size of the operator. However, the length of the seat 31 is limited by the length of the outer member 32 and the width of the seat 31 is limited by the length of the supporting members 40. These limits allow the seat 31 to move easily within the longitudinal direction between the front legs 24 and rear legs 26.

FIG. 1 also illustrates a seat back 46 secured directly to the seat 31. Specifically, the seat back 46 is secured to a rear edge of the seat 31 by a connecting means such as connecting members 47. Therefore, the seat back 46 is movable with the seat 31 between the front 24 and rear 26 legs. Alternatively, FIG. 3 illustrates a seat back 46 secured to at least one cross bar 48, wherein the cross bar 48 is secured between the upper portion of the pair of rear legs 26. The cross bars 48 provide additional support to the frame of the exercise device 20 such that the seat back 46 can be secured directly to the frame of the exercise device 20. Therefore, the seat back 46 remains in a fixed position upon the movement of the seat 31 between the pair of front 24 and rear 26 legs. In both the preferred embodiments, illustrated in FIGS. 1 and 3, the seat 31 is orientated approximately parallel to a surface supporting the exercise device 20, and the seat back 46 is orientated approximately perpendicular to the seat 31. The seat back 46 may also be a fabric covered or vinyl covered foam cushion which is secured to a plywood base. The dimensions of the seat back 46 may also vary but the width of the seat back 46 is also limited by the length of the cross bars 48.

Figure 4:
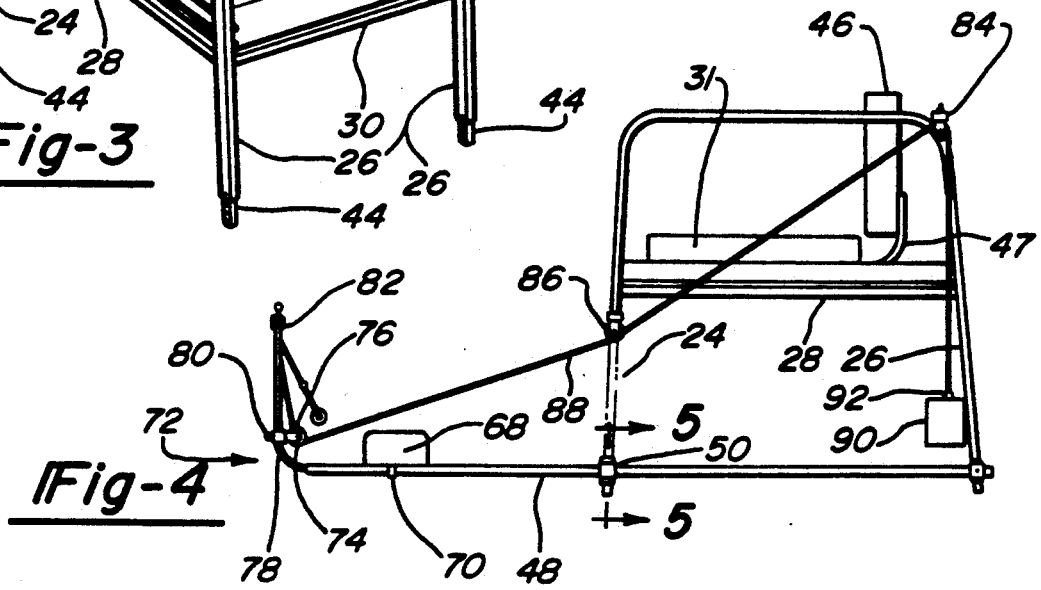
FIG. 4 is a view in side elevation of a third preferred embodiment of the multifunctional exercise device according to the present invention.
Figure 5:
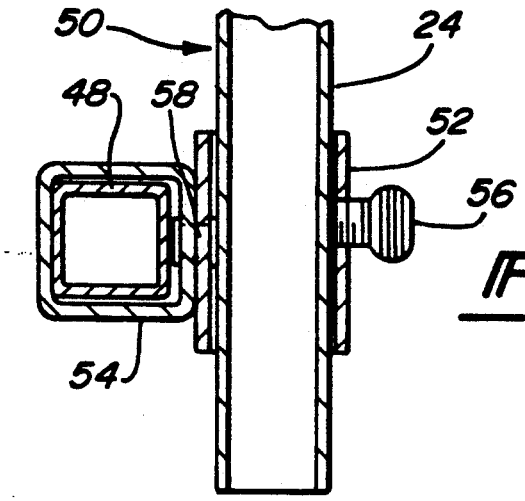
FIG. 5 is a sectional view along lines 5—5 of FIG. 4.
Figure 6:
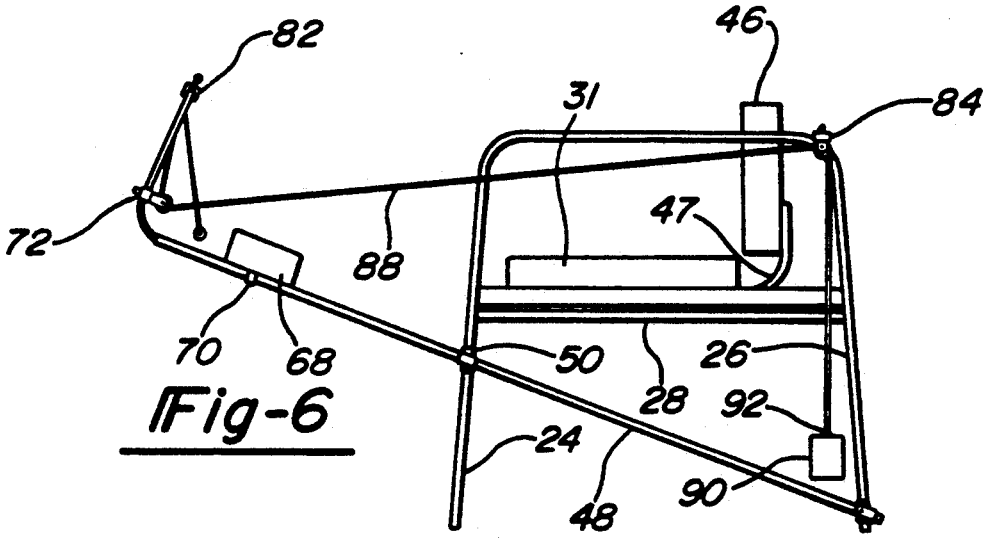
FIG. 6 is a view in side elevation of another preferred embodiment of the multifunctional exercise device according to the present invention.
Figure 7:
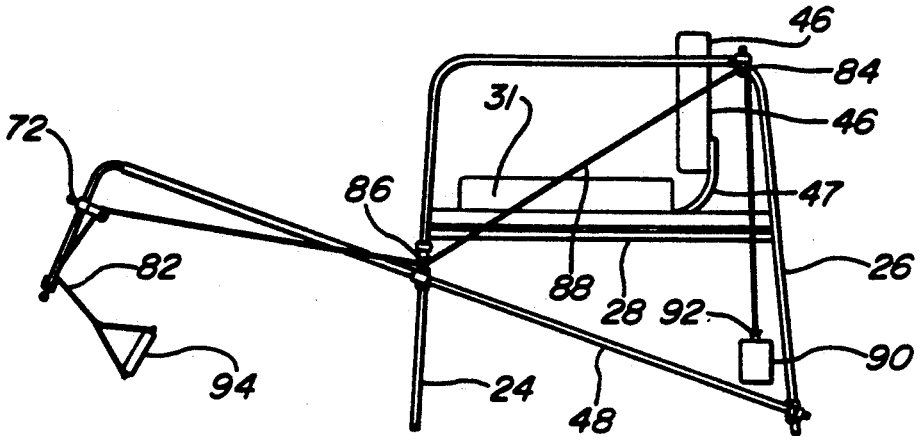
FIG. 7 is a view in side elevation of another preferred embodiment of the multifunctional exercise device according to the present invention.

Referring to FIGS. 4, 6 and 7, the exercise device 20 may include several attachments which may be adjustably attached to the frame of the exercise device 20. These attachments may be adjustably attached to either of the embodiments of the exercise device 20 illustrated in FIGS. 1 or 3. However, FIGS. 4 and 6–13 illustrate the attachments adjustably attached to the embodiment of the multifunctional exercise device 20 as illustrated in FIG. 1. It is known that the attachments can also be adjustably attached to the second preferred embodiment of the multifunctional exercise device 20 as illustrated in FIG. 3. Specifically, the attachments include a pair of beams 48, wherein each beam 48 may be adjustably attached to a front 24 and rear 26 leg. The beams 48 may be attached to both the front 24 and rear 26 legs by an adjustable attaching means 50. An adjustable attaching means 50 is illustrated in FIG. 5 and may include collar members 52 adjustably attached to each of the front 24 and rear 26 legs, and collar members 54 adjustably attached to the beams 48. The collar members 54 act as sleeves to various portions of the beams 48 including a rear segment of the beam 48 and an intermediate segment of the beam 48. The collar members 52 may be adjustably attached to the front 24 and rear 26 legs of the exercise device 20 with the assistance of a fastening means such as a thumbscrew 56 inserted into an aperture in the collar member 52. Thus, the collar member 52 may be attached to various portions along the length of the front 24 or rear 26 legs. The two collar members 52 and 54 are pivotally attached together by various means including a fastener or rivet 58 secured between the collar members 52 and 54. Therefore, either one or both of the beams 48 may be attached to the front 24 and rear 26 legs of the exercise device 20.

The adjustable attaching means 50 also allows the operator to change the angle of attachment and the junction point between either the front 24 or rear 26 leg and the beam 48. The angle of attachment between either the front 24 or rear 26 leg and the beam 48 determines in part the exercises and the difficulty of the exercises an operator can perform while using the exercise device 20. Specifically, a rear segment of each of the beams 48 may be adjustably attached to a lower segment of each of the pair of rear legs 26 of the exercise device 20 by an adjustable attaching means. Alternately, a rear segment of one or both of the beams 48 may be attached to a lower segment of the rear leg 26 by inserting a fastener 60 of any sort through aligned apertures in the collar 52, rear leg 26, collar 54 and beam 48 as illustrated in FIG. 4. A front segment of each of the beams 48 extends beyond the pair of front legs 24. An intermediary segment of one or both of the beams 48 may also be adjustably attached to a lower segment of the front leg 24 by an adjustable attaching means 50. Therefore, the beams 48 in the preferred embodiment illustrated in FIG. 4 are orientated approximately parallel to a surface supporting the exercise device 20.

FIG. 6 illustrates another preferred embodiment of the present invention. For example, the lower segment of each of the rear legs 26 is attached to rear segment of each of the beams 48. The front segment of each of the beams 48 also extends beyond the pair of front legs 24. However, in FIG. 6 the intermediary segment of the beams 48 is adjustably attached to the front legs 24, such that the junction point between the beam 48 and front leg 24 is approximately between the lower segment of the front leg 24 and the junction point between the front leg 24 and the side member 28. The operator may adjust the junction point between the beam 48 and front leg 24 depending in part upon the muscles to be exercised and the strength of the operator.

Figure 6A:
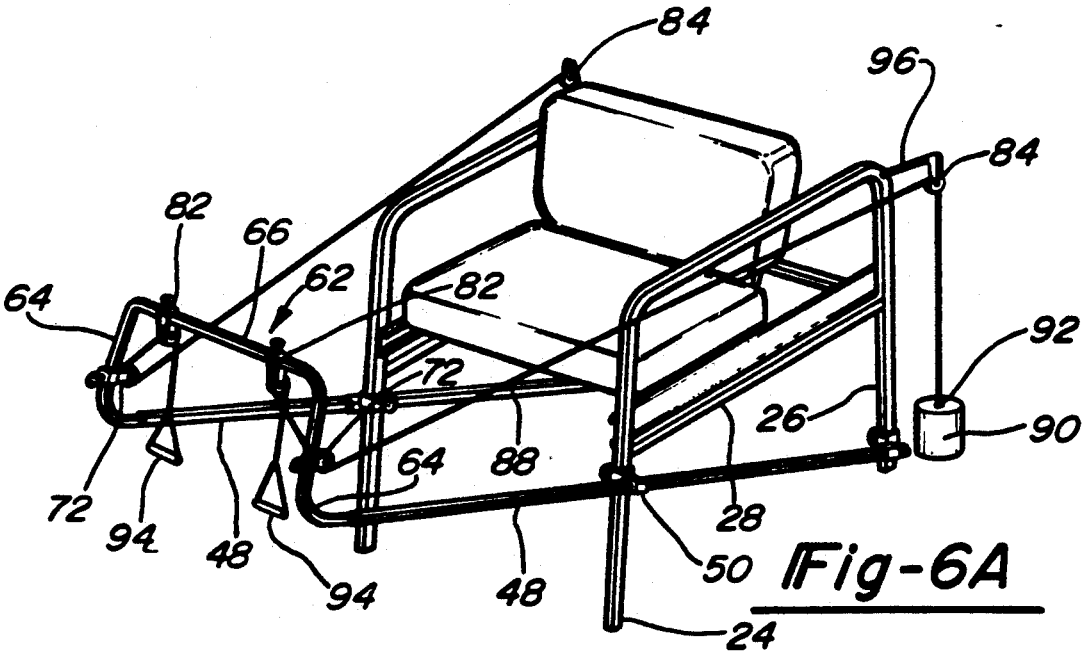
FIG. 6*a* is a frontal perspective view of the preferred embodiment of the multifunctional exercise device as illustrated in FIG. 6.

FIG. 7 also illustrates another preferred embodiment of the present invention, wherein the beams 48 are attached to the front 24 and rear 26 legs as illustrated in FIG. 6. As illustrated in FIG. 6*a*, the pair of beams 48 are connected by an intermediate member 62 having a pair of generally L-shaped members 64 connected by a front bar 66. The intermediate member 62 may connect the beams 48 in the preferred embodiments as illustrated in FIGS. 4, 6 and 7. The intermediate member 62 may be a one-piece member or may consist of several separate members welded or secured together by a threaded engagement of any sort. Generally, the length of the beam 48 should be such that a user can fully extend his legs approximately parallel to a surface supporting the exercise device 20. In the defined space between the beams 48 and the intermediate member 62, the operator can perform various exercises to strengthen and rehabilitate the various muscles within the leg, knee, arm and shoulder.

A means for supporting the limbs of an operator such as a footrest 68 is illustrated in FIGS. 4 and 6, wherein the footrest 68 is supported between the pair of beams 48. The footrest 68 may have an attaching means secured to an underside of the footrest 68 which helps to secure the footrest to the beams 48. Specifically, a clip 70 may be secured to the underside of the footrest 68, wherein the clip 70 may temporarily secure the footrest 68 to the beams 48. The footrest 68 can be temporarily secured at a variety of positions along the front segment of the beams 48, corresponding to the length of the operator's limbs. Once temporarily secured, the footrest 68 can support the limbs of an operator, thereby allowing the operator to perform a variety of exercises. For example, the footrest 68 may support the operator's feet or the lower portion of the operator's legs as illustrated in FIGS. 4 and 6. In addition, the footrest 68 may also be utilized in the embodiment of the exercise device as illustrated in FIG. 7. Alternately, the intermediate member 62 may be eliminated and the footrest 68 may be secured between the beams 48 and used to support the limbs of an operator. The footrest 68 may be a vinyl covered or fabric covered foam cushion secured to a plywood base.

A varied number of pulley arrangements may be adjustably attached to the various embodiments of the multifunctional exercise device 20 as illustrated in FIGS. 4, 6 and 7. FIGS. 4, 6 and 7 illustrate a side view of the preferred embodiments of the present invention wherein pulley arrangements are adjustably attached to one side of the exercise device 20. The present invention includes pulley arrangements adjustably attached to one or both sides of the exercise device 20 as illustrated in FIG. 6*a*. Specifically, FIGS. 4, 6 and 7 illustrate a first pulley arrangement 72 consisting of a first pulley 74 having a support 76 attached to a sleeve 78 by welding (as illustrated) or any other fastening means. The sleeve 78 is adjustably attached to various positions along the L-shaped member 64 of the intermediate member 62 with the use of a fastener of various types including a set screw 80.

FIGS. 4 and 7 also illustrate a second pulley arrangement 82, third pulley arrangement 84 and fourth pulley arrangement 86 adjustably attached to the front bar 66, rear leg 26 and front leg 24, respectively. The second 82, third 84 and fourth 86 pulley arrangements are generally similar to the first pulley arrangement 72 varying only in the location of attachment to the exercise device 20. Specifically, the second pulley arrangement 82 may be adjustably attached to the front bar 66 of the intermediate member 62. The third pulley arrangement 84 may be adjustably attached to an upper segment of the rear leg 26, approximately above the junction point between the rear leg 26 and side member 28. The fourth pulley arrangement 86 may be adjustably attached to the front leg 24 approximately below the junction point between the side member 28 and the front leg 24 and approximately above the junction point between the beam 48 and the front leg 24 as illustrated in FIGS. 4 and 7. FIG. 6 illustrates another preferred embodiment of the present invention including the first 72, second 82, and third 84 pulley arrangements adjustably attached to the L-shaped member 64, front bar 66, and rear leg 26 respectively. The total number and location of the pulley arrangements adjustably attached to the various embodiments of the exercise device 20 may vary depending upon the exercises to be performed and the desired difficulty of the exercises.

A cable 88 will be entrained over the pulleys in the various pulley arrangements adjustably attached to each side of the exercise device 20. One or two cables 88 may be utilized depending upon whether the operator desires to exercise one or both of his legs or arms. In order to perform certain leg, arm, shoulder and knee exercises, the cable 88 will be entrained over various pulleys in the first 72, second 82, third 84 and fourth 86 pulley arrangements as illustrated in FIGS. 4 and 7. Other exercises may require the cable 88 to be entrained over only a limited number of pulleys such as the pulleys within the first 72, second 82 and third 84 pulley arrangements as illustrated in FIG. 6.

At a rear extremity of the cable 88 a weight 90 of varying amounts is secured. An eye 92 may be provided at the top of the weight 90 for the attachment of the cable 88. A means for receiving the limb of the operator 94, such as a sling or a stirrup 94, is attached to a forward extremity end the cable 88. The pin member 96 is retained in an aperture in the upper segment of the rear leg 26 at such an angle, thereby creating a defined space between the rear leg 26, and cable 88 and weight 90. Therefore, the pin member 96 guides the cable 88 and ensures minimal or no contact between the cable 88 and weight 90 and the rear leg 26.

Figure 8:
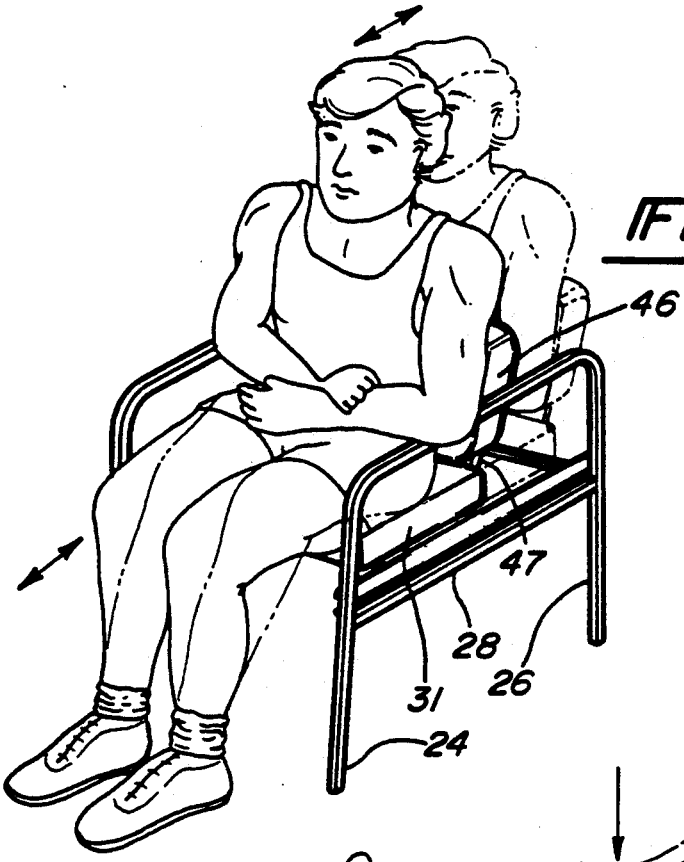
FIG. 8 is a view in side elevation of the device of FIG. 1, illustrating the operation thereof.

In use, the operator may be supported by the seat 31 while his feet are placed approximately parallel to the floor or any other surface supporting the exercise device 20. The operator will attempt to keep his feet stationary, while moving the seat 31 in a forward and backward direction, as illustrated in FIG. 8. The movement should be slow and the distance between forward and backward movement should be minimal. In the event the operator is of a smaller than average size, the operator may assemble the exercise device as illustrated in FIG. 4. The operator may support his feet on the footrest 68 and proceed to move the seat 31 in a forward and backward direction.

Figure 9:
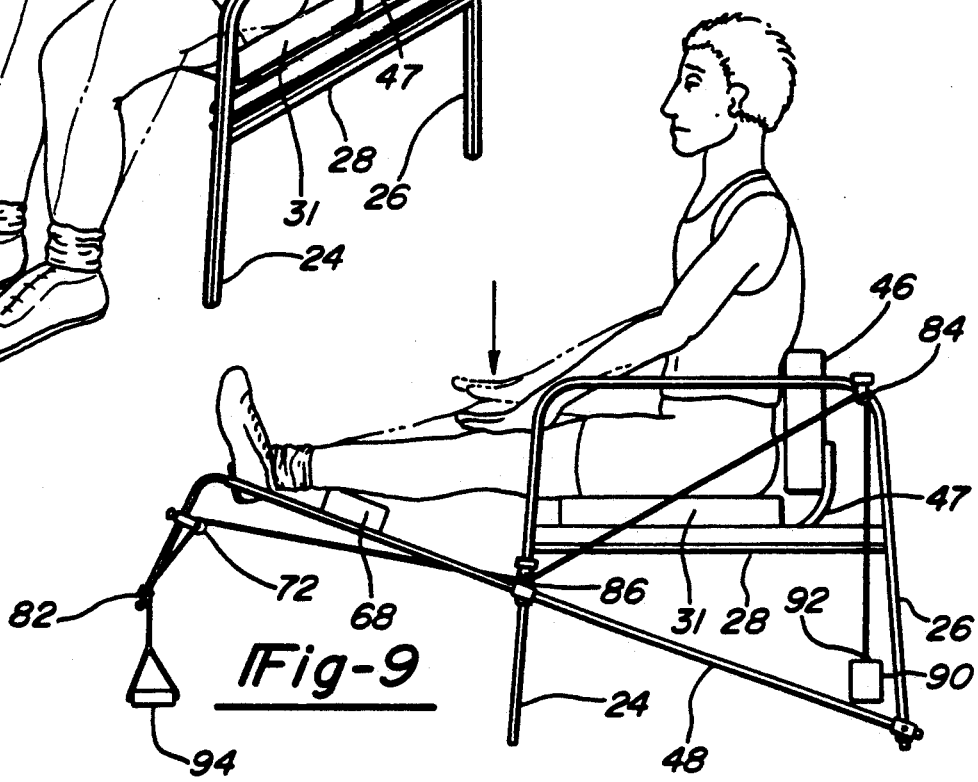
FIG. 9 is a view in side elevation of the device of FIG. 7, illustrating the operation thereof.

Another exercise as illustrated in FIG. 9 requires the operator to be supported by the seat 31, while his legs are extended outward and are approximately parallel to the floor. The operator's feet or lower legs will be supported by the footrest 68. The operator may then gently apply downward pressure to the knees and area surrounding each of the knees. The operator can also perform this exercise utilizing the preferred embodiment of the exercise device 20 as illustrated in FIG. 6. Alternately, the operator can also perform this exercise using an exercise device 20 having adjustably attached beams 48, whereby the intermediate member 62 is eliminated and the footrest 68 is supported by the beams 48.

Figure 10:
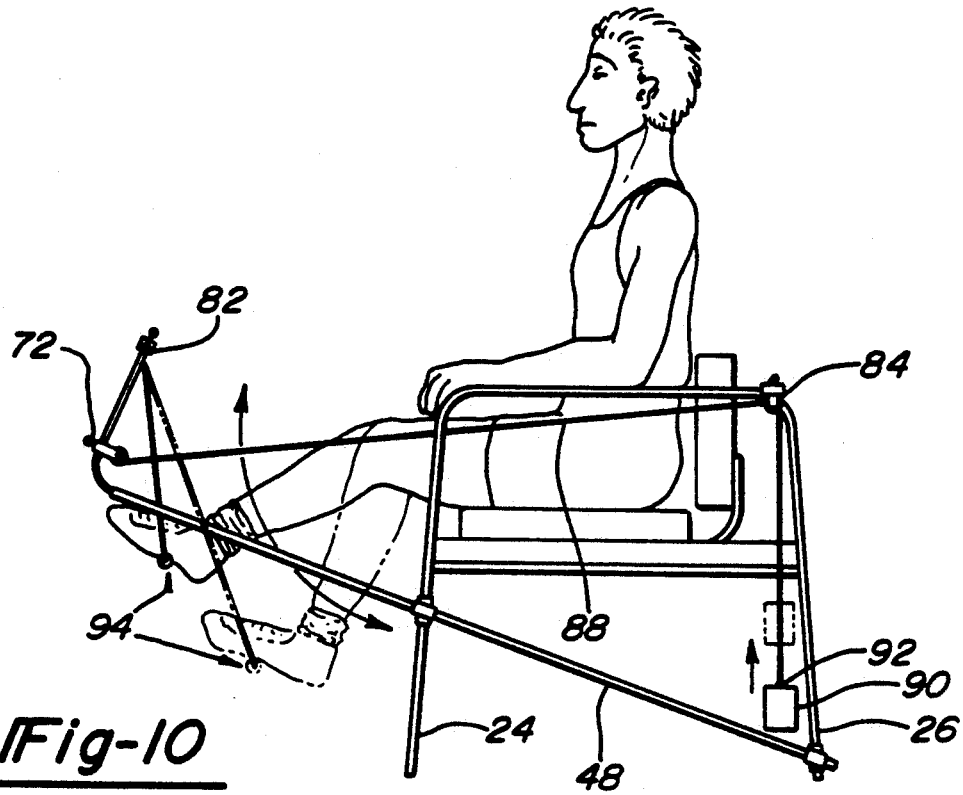
FIG. 10 is a view in side elevation of the device of FIG. 6, illustrating the operation thereof.
Figure 11:
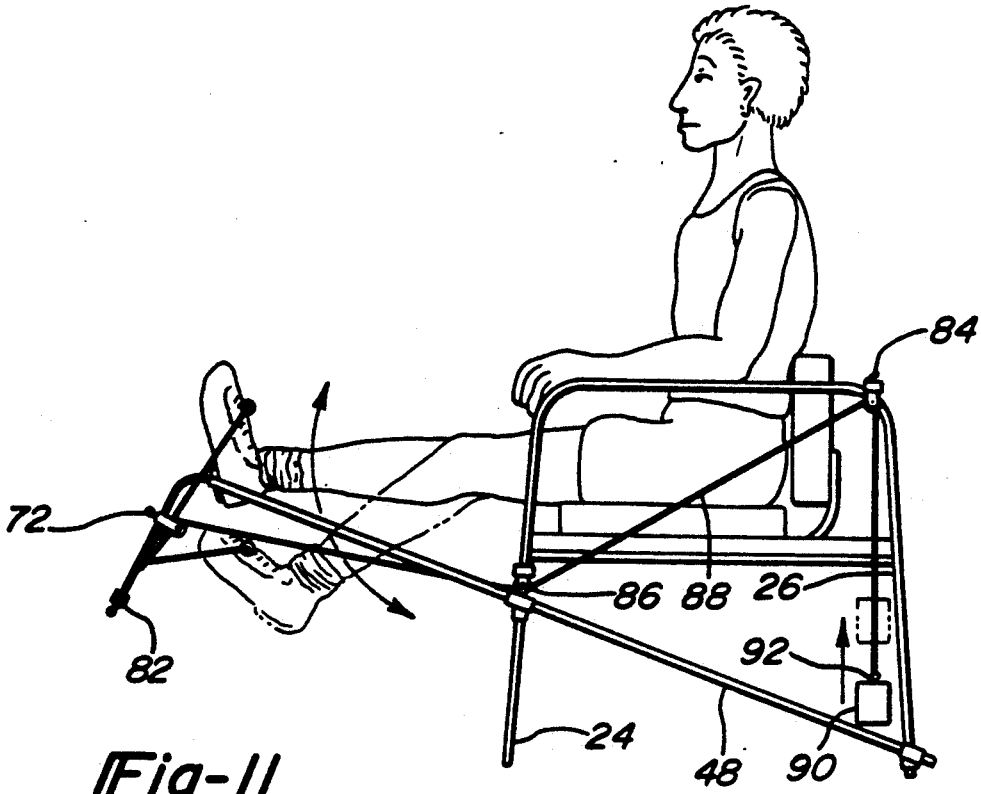
FIG. 11 is a view in side elevation of the device of FIG. 7, illustrating the operation thereof.

The operator may perform various exercises including the exercises illustrated in FIGS. 10 and 11, wherein the operator's legs are extended within the space defined by the beams 48 and the intermediate member 62. The operator may then place either one or both of his feet into the receiving means 94 on the front extremity of either one or both of the cables 88. The operator can proceed to raise and lower, or lower and raise either one or both of his legs. Again, this movement should be slow, and the distance between the upward and downward movement should not be excessive.

Figure 12:
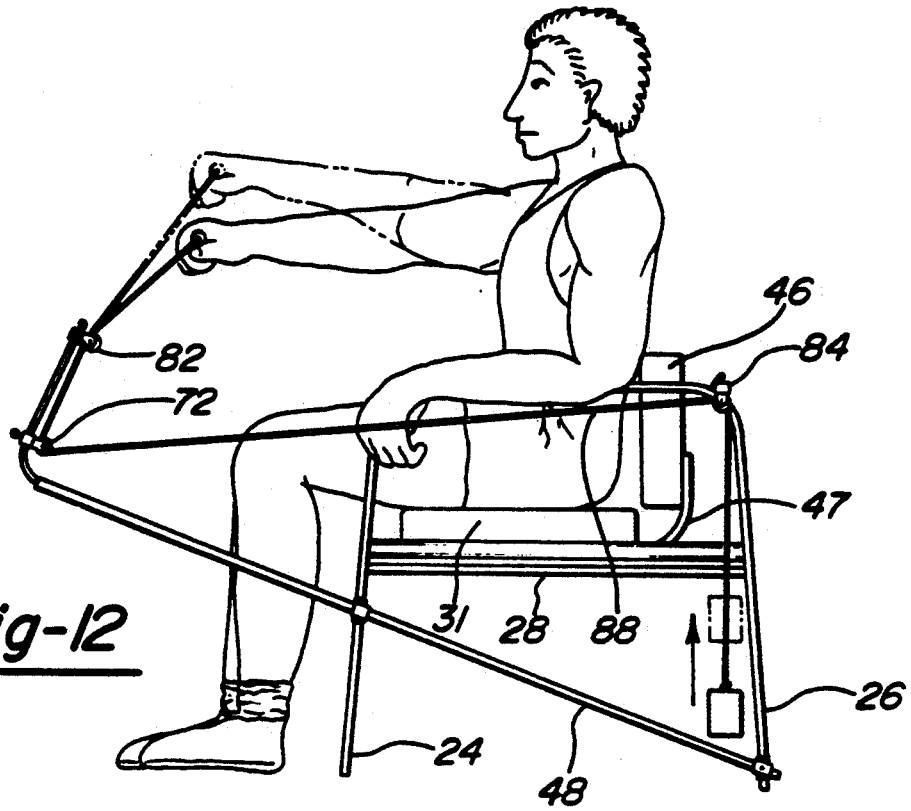
FIG. 12 is a view in side elevation of FIG. 6, illustrating the operation thereof.
Figure 13:
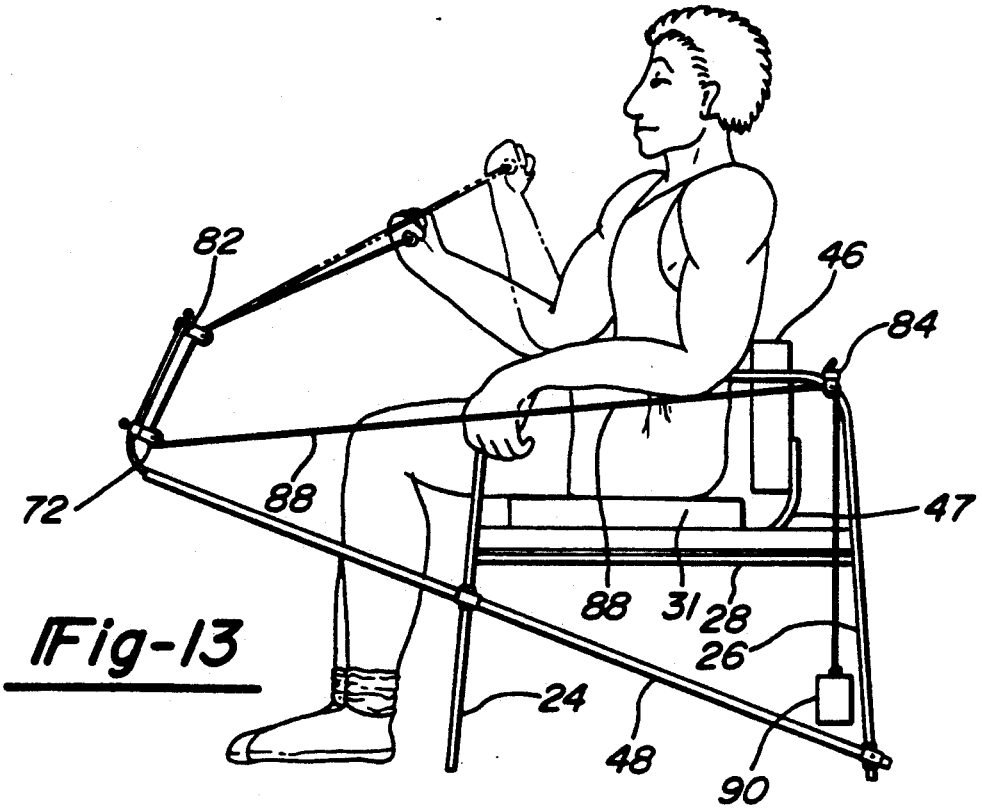
FIG. 13 is a view in side elevation of FIG. 6, illustrating the operation thereof.

The operator can also perform arm and shoulder exercises using the preferred embodiment of the exercise device 20 as illustrated in FIGS. 4, 6 and 7. For example, an operator may be supported by the seat 31 as illustrated in FIGS. 12 and 13. The operator may grip either one or both of the receiving means 94 in his hand and pull either one or both of the cables 88 in a direction towards and away from his chest as illustrated in FIG. 12. The operator can also grip the receiving means 94 in his hand and bend his arm at the elbow, thereby pulling the cable 88 in a direction towards and away from his chest as illustrated in FIG. 13. The operator can perform these exercises by gripping either one or both of the receiving means 94, thereby exercising muscles within one or both of his shoulders and arms. The operator can also pull the cable 88 in a variety of other directions in order to exercise various additional muscles within his upper body. Similarly, the exercises described to strengthen the arms and shoulders, as well as additional exercises can also be performed by an operator utilizing a preferred embodiment of the exercise device 20 as illustrated in FIGS. 4 and 7.

It can be seen that the multifunctional exercise device 20 of the present invention has many advantages including the ability to perform a variety of exercises for the arm, shoulder, knee and leg. The exercises and stretches that can be performed using the present invention include: reciprocal motion exercises for the knees and for the elbows and shoulders; resistive or assistive knee extension or flexion exercises; resistive or assistive elbow extension or flexion exercises; resistive downward rotation and depression of the shoulders or assistive upward rotation and elevation thereof; and hamstring and quadriceps stretching. It will be obvious to one of ordinary skill that numerous modifications may be made without departing from the spirit and scope of the invention and that many other applications may be made in the way of varied cable and pulley arrangement attachments, and varied attachments between the beams and leg members of the exercise device, and that the invention is to be limited only by the appended claims.

I claim:

1. An exercise device comprising:

a pair of front legs;

a pair of rear legs;

a seat;

slidable means, connecting said front legs to said rear legs, for supporting said seat and allowing said seat to be longitudinally movable toward and away from said front legs;

a pair of beams having a front section extending forwardly beyond a front edge of said seat;

attaching means for attaching each of said rear legs to one of said beams;

attaching means for attaching each of said front legs to one of said beams;

an intermediate member connecting said pair of beams;

at least one pulley arrangement attached to one of said rear legs;

at least one pulley arrangement attached to said intermediate member;

a first cable entrained over said pulley arrangements attached to said intermediate member and said rear leg;

a weight connected to a rear extremity of said first cable; and receiving means on a front extremity of said first cable for engaging a limb of an operator sitting on said seat, whereby placing various amounts of said weight provides varying degrees of assisting force to aid in the exercise of the limb.

2. An exercise device according to claim 1, further comprising:

at least one pulley arrangement attached to one of said front legs; and said first cable entrained over said pulley arrangements on said intermediate member, said rear leg and said front leg.

3. An exercise device according to claim 1, further comprising:

a pair of side members connecting said front legs to said rear legs; and a rear member connecting said pair of rear legs.

4. An exercise device according to claim 1, wherein said attaching means for attaching each of said front legs to one of said beams is such that each of said beams is approximately parallel to a surface supporting said exercise device.

5. An exercise device according to claim 1, wherein said attaching means for attaching each of said front legs to one of said beams is such that a junction point between said beam and said front leg is between a surface supporting said exercise device and a connection point between said front leg and said slidable means.

6. An exercise device according to claim 1, further comprising:

at least one pulley arrangement attached to each of said rear legs;

a second cable entrained over said pulley arrangements attached to said intermediate member and said rear leg;

a weight connected to a rear extremity of said second cable; and receiving means on a front extremity of said second cable, for engaging a limb of an operator sitting on said seat, whereby placing various amounts of said weight provides varying degrees of assisting force to aid in the exercise of the limb.

7. An exercise device according to claim 1, further comprising:

at least one pulley arrangement attached to each of said rear legs;

at least one pulley arrangement attached to each of said front legs;

a first cable entrained over said pulley arrangements attached to said intermediate member, said rear leg, and said front leg;

a second cable entrained over said pulley arrangements attached to said intermediate member, said rear leg, and said front leg;

a weight connected to a rear extremity of said second cable; and receiving means on a front extremity of said second cable, for engaging a limb of an operator sitting on said seat, whereby placing various amounts of said weight provides varying degrees of assisting force to aid in the exercise of the limb.

* * * * *